US006457853B1

(12) United States Patent
Engel

(10) Patent No.: US 6,457,853 B1
(45) Date of Patent: Oct. 1, 2002

(54) IMPELLER DEVICE AND METHOD

(75) Inventor: David Engel, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/750,272

(22) Filed: Dec. 29, 2000

(51) Int. Cl.[7] ..... B01F 7/22

(52) U.S. Cl. ..... 366/326.1; 366/327.1; 366/330.2; 366/330.3; 416/207

(58) Field of Search ..... 366/327.1, 327.2, 366/330.1, 330.2, 330.3, 330.6, 326.1; 416/207, 225, 163, 196 R, 198 R, 205, 210 R, 212 R, 214 R, 219 R, 229 R, 233

(56) References Cited

U.S. PATENT DOCUMENTS 1,184,394 A * 5/1916 Stout ..... 366/325.4
1,833,059 A * 11/1931 Thomes ..... 416/229 R
2,265,788 A * 12/1941 Wolf et al. ..... 416/205
2,872,987 A * 2/1959 Gahagan ..... 416/229 R
3,408,373 A * 10/1968 Talbot ..... 554/94
3,695,780 A * 10/1972 Velkoff ..... 416/225
3,741,681 A * 6/1973 De Witt ..... 416/212 R
4,095,918 A * 6/1978 Mouton et al. ..... 416/132 B
5,061,082 A * 10/1991 Steele ..... 366/326.1
5,462,411 A * 10/1995 Bianchi ..... 416/210 R

* cited by examiner

*Primary Examiner*—Tony G. Soohoo
(74) *Attorney, Agent, or Firm*—Baker & Hostetler, LLP

(57) ABSTRACT

An impeller for use in a mixing apparatus having a rotating shaft has at least one longitudinal member extending substantially radially from the shaft; and a plurality of individual impeller segments each having a bore therethrough. The segments are stacked together with the longitudinal member extending through said bores. The longitudinal member may be an at least partially threaded rod or may be a beam. A method of assembling an impeller for use in a mixing apparatus having a rotating shaft employs the steps of stacking a plurality of individual impeller segments onto a longitudinal member that extends substantially radially from the shaft; and fastening the stacked impeller segments onto the longitudinal member to retain the impeller segments on the longitudinal member.

23 Claims, 2 Drawing Sheets

IMPELLER DEVICE AND METHOD

FIELD OF THE INVENTION

The present invention relates generally to impellers that are mounted to rotating shafts for use in a variety of reactors, vessels and mixing apparatus. Rotating shafts with impellers and such vessels are in wide use in the chemical, petroleum, pharmaceutical, cosmetic, food preparation and other industries.

BACKGROUND OF THE INVENTION

Impellers mounted to rotating shafts in mixing vessels are well known. Commercial mixing vessels typical have two, three, or four impellers extending radially outward from the rotating shaft. These impellers often are manufactured from sheet stock by being formed and then further processed if necessary to provide a finished impeller that can be mounted to the shaft. The labor involved in forming and finishing an impeller can be extensive, particularly since different impeller shapes are used in different sizes and shapes of mixing vessels and for different applications.

Accordingly, it is desired to have a method and device for providing a finished impeller quickly and inexpensively, where the impeller can be adapted to have different sizes and shapes to fit the particular mixing requirement.

SUMMARY OF THE INVENTION

It is therefore a feature and advantage of the present invention to provide a finished impeller quickly and inexpensively, where the impeller can be adapted to have different sizes and shapes to fit the particular mixing requirement.

It is another feature and advantage of the present invention to provide an impeller device and method utilizing individual impeller sections mounted in a stacked arrangement onto a beam or rod, which may be at least partially threaded. The above and other features and advantages are achieved through the use of a novel impeller device and method as herein disclosed.

In accordance with one embodiment of the present invention, an impeller for use in a mixing apparatus having a rotating shaft has at least one longitudinal member extending substantially radially from the shaft; and a plurality of individual impeller segments each having a bore therethrough. The segments are stacked together with the longitudinal member extending through said bores.

In one embodiment, the longitudinal member may be an at least partially threaded rod, and in another embodiment, the longitudinal member may be a beam.

In accordance with another aspect of the present invention, a method of assembling an impeller for use in a mixing apparatus having a rotating shaft is provided, employing the steps of stacking a plurality of individual impeller segments onto a longitudinal member that extends substantially radially from the shaft; and fastening the stacked impeller segments onto the longitudinal member to retain the impeller segments on the longitudinal member.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides an impeller assembly in which a plurality of individual impeller sections are stacked on a beam or rod in order to form a finished impeller having a desired shape. The invention also provides a method of assembling an impeller in which individual sections are stacked on a beam or rod and fastened thereto.

Figure 1:
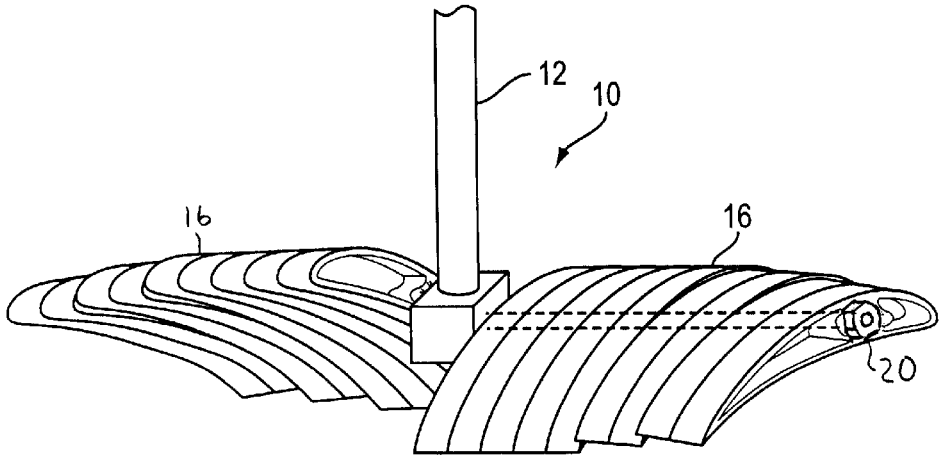
FIG. 1 is a perspective view showing an impeller constructed according to a first preferred embodiment of the invention.
Figure 2:
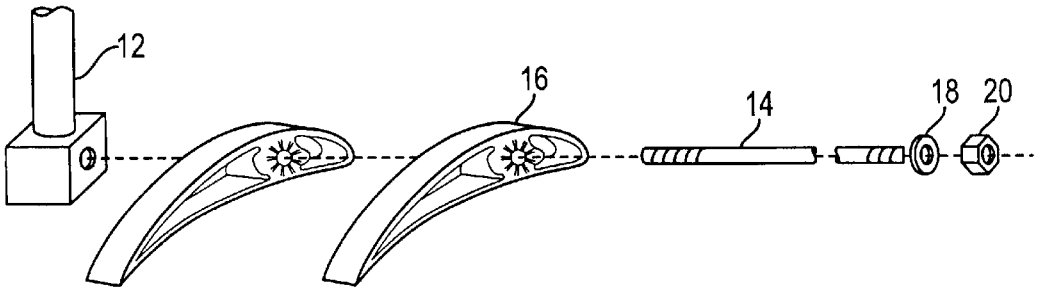
FIG. 2 is an exploded view of the impeller shown in FIG. 1.
Figure 3:
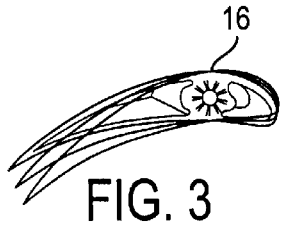
FIG. 3 is an end view of the impeller shown in FIG. 1

A first preferred embodiment of the present inventive apparatus and method is illustrated in FIG. 1. This embodiment includes an impeller assembly 10 that is mounted to a rotating shaft 12. The impeller assembly 10 includes a threaded rod or 14 that extends outward radially from the rotating shaft 12. A plurality of individual impeller sections 16 are mounted onto the shaft 14 as shown in FIGS. 1 and 2. A washer 18 and bolt 20 are fastened on the end of the rod 14 in order to provide a compressive force on the stack of impeller sections 16 to hold the impeller sections on the rod 14. The rod 14 passes through a bore 20 in each individual section 16. A shaping 22 which may be a frictional surface finish, a radial serration, radial fins, ribs or splines, or any other shape that provides frictional engagement against rotation, or an incremental clocking effect, is provided on the side surfaces of each individual section 16. The shaping 22 prevents the individual sections from rotating about the shaft 14 once the bolt 20 is sufficiently tightened. As shown in FIGS. 1 and 3, the individual sections can be rotated to a desired position before the bolt is tightened, with different sections angled at different degrees of rotation, to provide a desired overall impeller shape. In the example shown in FIG. 1, the sections located closer to the shaft 12 are positioned to have a greater attack angle than those located farthest away from the shaft 12.

Figure 4:
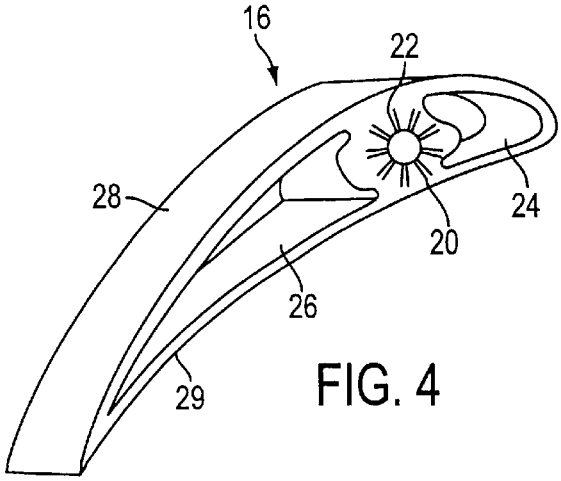
FIG. 4 is a perspective view of an individual section of an impeller.

FIG. 4 illustrates the individual sections 16 in more detail. In the example shown in FIG. 4, the section 16 has a bore 20, shaping 22, hollowed portions 24 and 26, top surface 28, and lower surface 29. The upper surface 28 and lower surface 29 in the example of FIG. 4 are shaped to give the individual section an overall airfoil profile shape. Although such an airfoil shape is often desirable for mixing impellers, each section could provide any suitable shape. The hollowed areas 24 and 26 are provided to reduce the amount of material arid the weight of the individual impeller sections.

In this embodiment, it is possible to use a plurality of sections 16 that are substantially identical to each other, arranged if desired at varying angles to provide different angles of attack at the different radial locations. In this way it is possible to provide an impeller having a profile with a changing angle along its length. It is also possible to use more than one section shape. For example, different sections having different thicknesses, airfoil profiles, lengths, etc. can be used and stacked in any desired order and at any desired angle to form an impeller with a desired shape.

Figure 6:
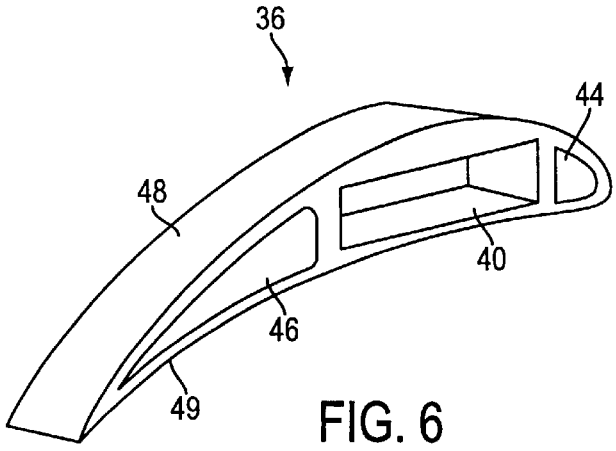
FIG. 6 is a perspective view of an individual section of an impeller according to the embodiment of FIG. 5.
Figure 5:
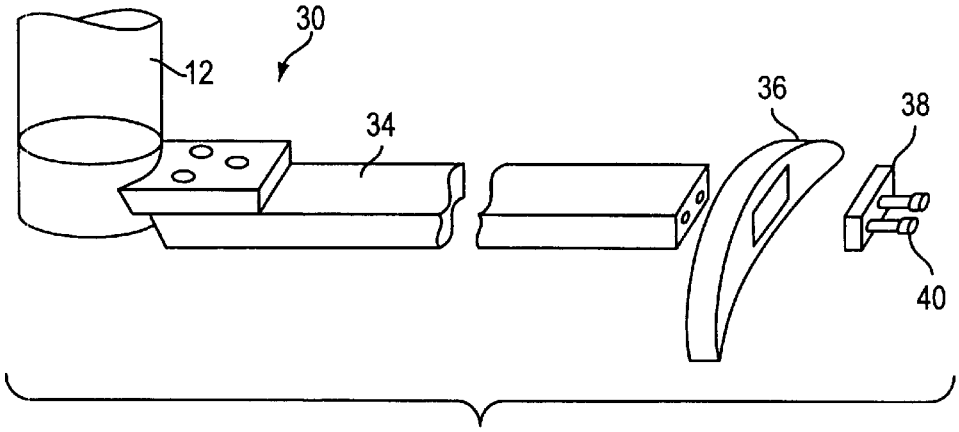
FIG. 5 is an exploded view of an impeller constructed according to a second preferred embodiment of the invention.
Figure 7:
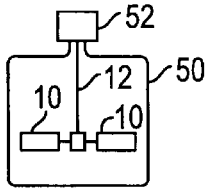
FIG. 7 is a cutaway view of a mixing apparatus using an impeller according to the present invention.

FIGS. 5 and 6 show a second embodiment of the present invention. In this embodiment of an assembly 30, a beam 34 extends radially from the rotating shaft 12. The beam 34 has a geometric cross section such as square, rectangular, keyed, splined, or any shape that can have a keying effect with the individual sections to prevent the individual sections 36 from rotating about the beam 34. The individual sections 36 fit over the beam and are retained by an end plate 38 fastened to the end of the beam with screws 40.

As shown in FIG. 6, the individual sections 36 in this embodiment have a bore 40 that corresponds in shape to the cross sectional shape of the beam 34. In the illustrated example, the shaft 34 is rectangular and the bore 40 has a complementary rectangular shape. When slid onto the beam 34, the section 36 cannot rotate relative to the beam 34. This can of course be accomplished by providing the shaft 34 and the bore 40 with any complementary shape that would prevent rotation of the section 36 on the beam 34. This embodiment may in some examples provide improved load bearing ability compared to the first embodiment, due to the shape of the beam and the amount of load handled by the beam rather than the sections. Also, in some examples this embodiment does not require as high a compressive force on the sections, because there is no need for a tight frictional fit between the sides of the sections to hold them against rotation.

In this embodiment, it is also possible to use more than one section shape. For example, different sections having different thicknesses, airfoil profiles, lengths, etc. can be used and stacked in any desired order to form an impeller with a desired shape. In the first embodiment of FIGS. 1–4, compressive force and engagement between the sections themselves prevents rotation of the sections when assembled. In the second embodiment of FIGS. 5–6, interaction between the beam and the bore of each section prevents rotation. Accordingly, in the second embodiment, depending on the shape and interaction of the beam 34 and the bore 40, it may be necessary to use different sections having the bore 40 at different angles in order to have different angles of attack for each section (because it is not possible to rotate the section 36 around the beam 34 to a desired angle as in the first embodiment). However, depending on the cross-section of the beam and the shape of the bore 40, it is possible to have a bore 40 that is shaped to hold the beam 34 in more than one rotated position, and thus use a given section 36 at an angle selected from more than one angle.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An impeller for use in a mixing apparatus having a rotating shaft, comprising:

at least one longitudinal member extending substantially radially from the shaft, and a plurality of individual impeller segments each having a bore therethrough, said segments stacked together with said longitudinal member extending through said bores, wherein at least a portion of the individual impeller segments have a shaped surface to permit the segments to be independently oriented at varying angles to the longitudinal member as the segments are stacked together.

2. An impeller according to claim 1, wherein said longitudinal member is a rod.

3. An impeller according to claim 2, further comprising a fastener fastened to the rod to provide compressive force to said stacked segments to retain said impeller segments on said rod.

4. An impeller according to claim 3, wherein said rod has threads and said fastener is threaded onto an end of the rod.

5. An impeller for use in a mixing apparatus having a rotating shaft, comprising:

at least one longitudinal member extending substantially radially from the shaft, wherein said longitudinal member is a rod;

a plurality of individual impeller segments each having a bore therethrough, said segments stacked together with said longitudinal member extending through said bores wherein said impeller segments have sides which abut adjacent ones of said stacked segments, and each side has a shaped surface substantially surrounding the bore that engages with adjacent ones of said shaped surfaces to prevent relative rotation of adjacent stacked segments about said longitudinal member when said fastener is fastened; and a fastener fastened to the rod to provide compressive force to said stacked segments to retain said impeller segments on said rod, wherein said rod has threads and said fastener is threaded onto an end of the rod.

6. An impeller according to claim 5, wherein said fastener imparts compressive force to said stacked segments.

7. An impeller according to claim 5, wherein said shaped surface includes at least one of radial teeth, radial splines, and surface roughening.

8. An impeller according to claim 5, wherein said shaped surface provides a clocking relationship between adjacent ones of said impeller segments.

9. An impeller according to claim 5, wherein impeller segments are substantially identical to each other.

10. An impeller according to claim 5, wherein said impeller segments include at least one said impeller segment having a different outer profile than at least one of said other impeller segments.

11. An impeller for use in a mixing apparatus having a rotating shaft, comprising:

at least one beam extending substantially radially from the shaft; and a plurality of individual impeller segments each having a bore therethrough, said impeller segments stacked together with said beam extending through said bores, wherein said beam has a cross-sectional shape and said bore has a complementary shape to the cross-sectional shape of the beam.

12. An impeller according to claim 11, further comprising a fastener fastened to the beam to retain said stacked impeller segments on said beam.

13. An impeller according to claim 11, wherein said fastener includes an end plate attached to the end of said beam.

14. An impeller according to claim 11, wherein said impeller segments are substantially identical to each other.

15. An impeller according to claim 11, wherein said impeller segments include at least one said impeller segment having a different outer profile than at least one of said other impeller segments.

16. A method of assembling an impeller for use in a mixing apparatus having a rotating shaft, comprising the steps of:

stacking a plurality of individual impeller segments onto a longitudinal member that extends substantially radially from the shaft, wherein the stacking step further comprises the step of orienting each impeller segment at a desired angle to the longitudinal member; and fastening the stacked impeller segments onto the longitudinal member to retain the impeller segments on the longitudinal member, wherein the fastening step further includes the step of preventing rotation of the oriented impeller segments about the longitudinal member.

17. A method according to claim 16, wherein the fastening step includes providing a compressive force to urge adjacent stacked impeller segments together.

18. An impeller according to claim 16, wherein said impeller segments are substantially identical to each other.

19. An impeller according to claim 16, wherein said impeller segments include at least one said impeller segment having a different outer profile than at least one of said other impeller segments.

20. An impeller assembly according to claim 16, wherein said impeller segments include at least one said impeller segment having a different outer profile than at least one of said other impeller segments.

21. An impeller assembly for use in a mixing apparatus having a rotating shaft comprising:

means for stacking a plurality of individual impeller segments to form an impeller that extends substantially radially from the shaft, wherein said stacking means further comprises means for orienting each impeller segment at a desired angle to the other impeller segments; and means for fastening the stacked impeller segments together to form the impeller, said fastening means further comprises means for preventing rotation of the oriented impeller segments relative to each other.

22. An impeller assembly according to claim 21, wherein said fastening means includes means for providing a compressive force to urge adjacent stacked impeller segments together.

23. An impeller assembly according to claim 21, wherein said impeller segments are substantially identical to each other.

* * * * *